United States Patent [19]

Johansson

[11] Patent Number: 4,977,696

[45] Date of Patent: Dec. 18, 1990

[54] DISPLAY RACK

[76] Inventor: Gert A. Johansson, Engelbrektsgatan 57, S-412 52 Göteborg, Sweden

[21] Appl. No.: 264,642

[22] PCT Filed: Apr. 8, 1987

[86] PCT No.: PCT/SE87/00178

§ 371 Date: Oct. 21, 1988

§ 102(e) Date: Oct. 21, 1988

[87] PCT Pub. No.: WO87/06754

PCT Pub. Date: Nov. 5, 1987

[30] Foreign Application Priority Data

Apr. 21, 1986 [SE] Sweden ..... 8601822

[51] Int. Cl.[5] ..... G09F 7/00

[52] U.S. Cl. ..... 40/605; 40/611; 160/135

[58] Field of Search ..... 40/605, 606, 607, 610, 40/611, 152.1; 160/135, 229.1, 351; 52/239, 71, 285, 286, 586, 578; 446/112, 111, 124; 403/300, 294

[56] References Cited

U.S. PATENT DOCUMENTS

| | | | |
|---|---|---|---|
| 2,865,124 | 12/1958 | Mortellito | 40/605 |
| 3,428,108 | 2/1969 | Singer | 40/605 |
| 3,537,200 | 11/1970 | Bubb | 40/605 |
| 4,166,332 | 9/1979 | Donovan | 40/605 |
| 4,566,211 | 1/1986 | Gustafson et al. | 40/605 |
| 4,644,993 | 2/1987 | Cooper et al. | 160/351 |
| 4,653,563 | 3/1987 | Bannister | 160/135 |
| 4,712,336 | 12/1987 | Backer | 160/351 |

FOREIGN PATENT DOCUMENTS

| | | | |
|---|---|---|---|
| 1933259 | 1/1971 | Fed. Rep. of Germany | 40/605 |
| 1313182 | 11/1962 | France | 160/135 |
| 669299 | 4/1952 | United Kingdom | 160/135 |
| 1185011 | 3/1970 | United Kingdom | 40/605 |
| 8404366 | 11/1984 | World Int. Prop. O. . | |

*Primary Examiner*—Kenneth J. Dorner
*Assistant Examiner*—J. Hakomaki
*Attorney, Agent, or Firm*—Sughrue, Mion, Zinn, Macpeak & Seas

[57] ABSTRACT

A display rack consists of flat pane display frames to be interconnected by coupling members. The frames comprise corner pieces and side frame members of extruded profiled tubes with two parallel tube portions and two longitudinal grooves in the plane of the display frame. The corner pieces have at least two pairs of parallel legs to be inserted and adopted by the tube portions. Of the longitudinal grooves at least one externally located groove of each display frame has an external opening narrower than the rest of the groove to prevent a dowel member introduced into the groove from passing out transversely. The corner pieces have cavities in the extension of the recessed grooves to permit the dowel members to be passed through the corner piece and into said recessed groove. Each coupling member has at least two dowels each of which is adapted for introduction through one of the cavities of a corner piece and further into the corresponding recessed groove in a frame side for interconnecting two or more adjacent display frames at nearby corners.

12 Claims, 4 Drawing Sheets

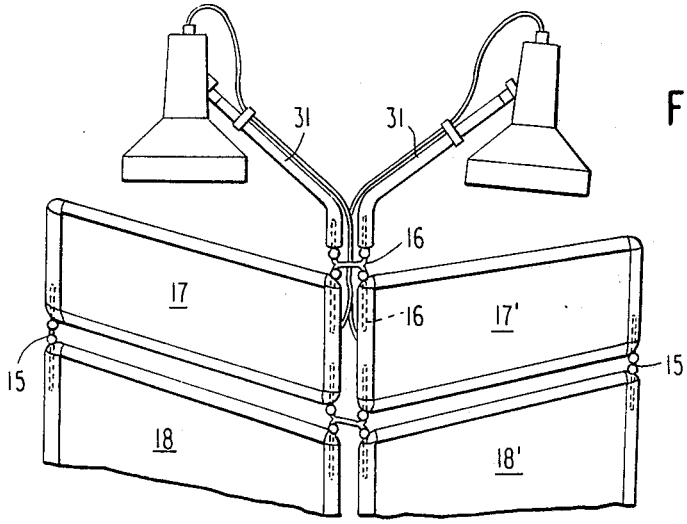
FIG. 10
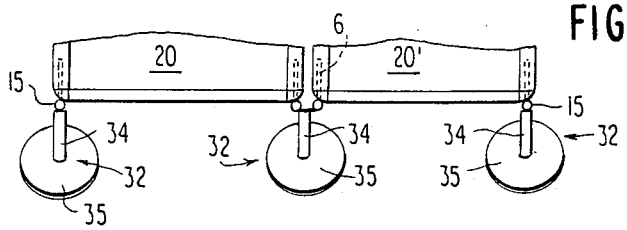
FIG. 11
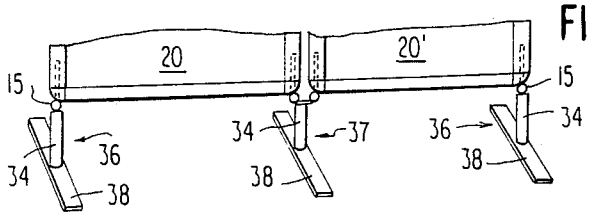
FIG. 12
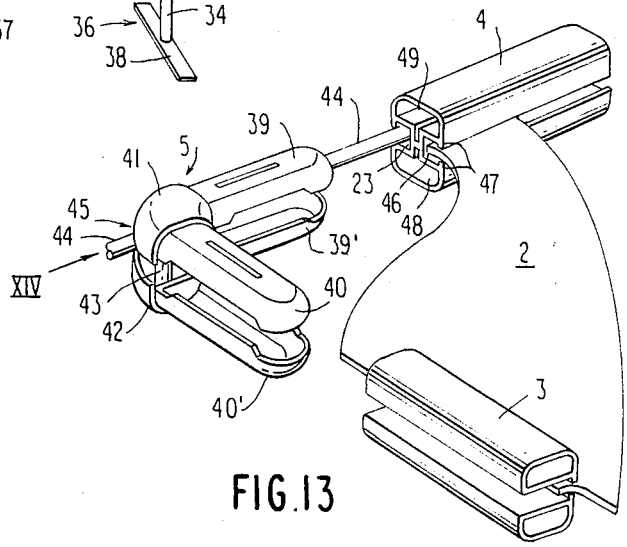
FIG. 13
FIG. 14
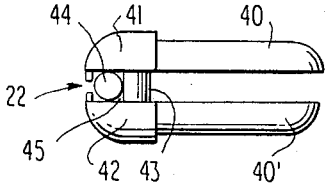

FIG. 15
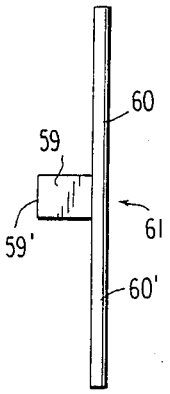
FIG. 17
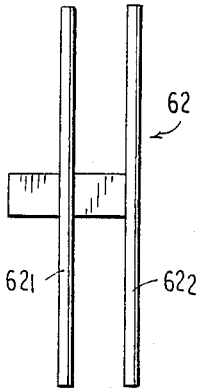
FIG. 19
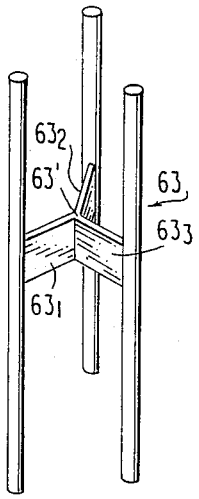
FIG. 21
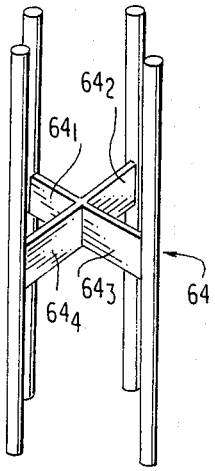
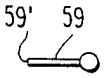
FIG. 16
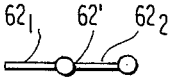
FIG. 18
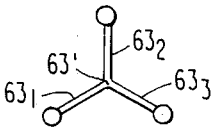
FIG. 20
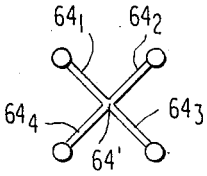
FIG. 22
FIG. 29
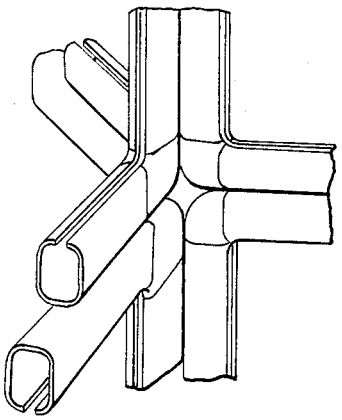
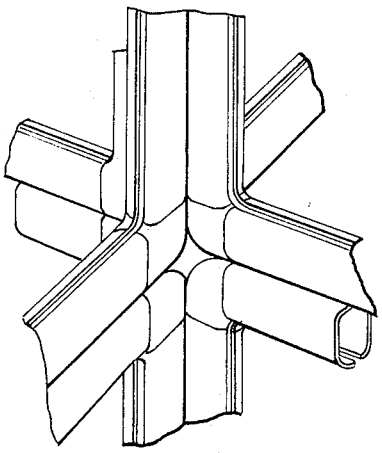
FIG. 30

FIG. 23
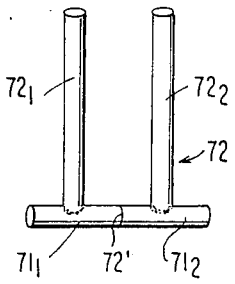
FIG. 25
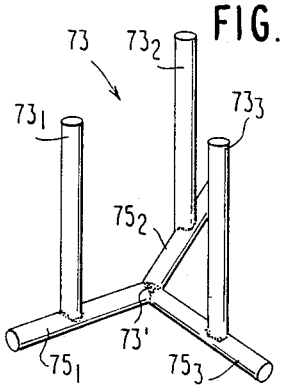
FIG. 27
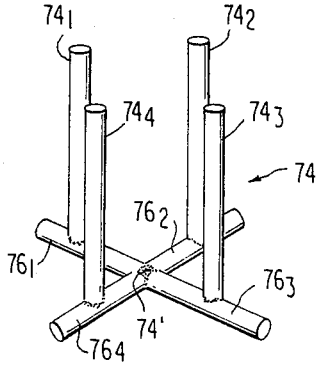
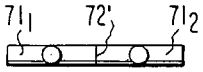
FIG. 24
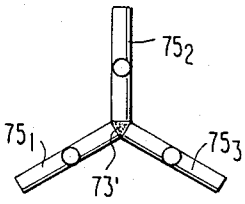
FIG. 26
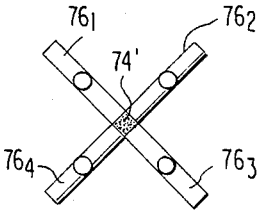
FIG. 28
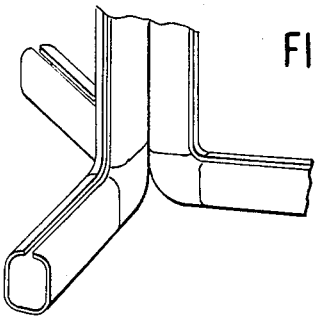
FIG. 31
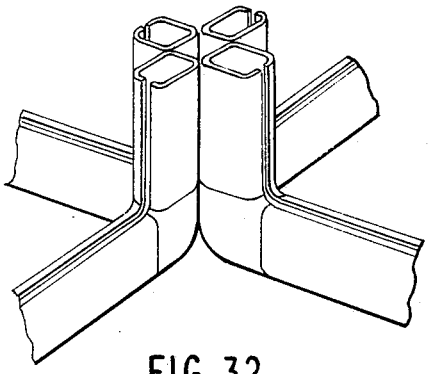
FIG. 32

DISPLAY RACK

The present invention concerns a display rack, which is built up from frames which enclose disks or plates, on which advertising and other information, prizes or the like can be shown, for example in shops, department stores and in exhibitions. The frames in such display racks are built up from, or composed of , side wall pieces of hollow extruded form consisting of two hollow-beam or tubular portions which are interconnected by means of a bridge portion. Said portions then between themselves forming two longitudinally extending grooves in the side pieces mainly in the plane of the assembled frame. In such frames which the invention relates to, lateral pieces of the frames are held together by corner pieces which are shaped with mutually rectangular pairs of legs or projections which can be inserted into said hollow beam or tubular portions of the side pieces.

Previously known frames are interconnected to larger racks or shields by means of fittings or couplings which are secured by screwing, or by means of other fixing means attached to the frames. This is often effected in a manner costly and complicated for this purpose.

It has now been found that an advantageous and amazingly simple and cheap method can result in a display rack which is highly flexible and has low weight, by developing the construction described in the international printed publication WO No. 84/04366 (patent application PCT/SE No. 84/00087). This is accomplished, according to the invention, thereby that of the mentioned longitudinal grooves, at least one externally located groove of each display frame is recessed, i.e. with an external opening of the groove being narrower than the rest of the groove in order to prevent a dowel member introduced into the groove from passing from the groove transversely to the longitudinal direction thereof. Further, the corner pieces are formed with cavities as extensions of the recessed grooves of the side members of the frames so as to permit the dowel members to pass without any obstacle through the corner piece and into said recessed groove. Each coupling member further comprises at least two dowels members, each of which is adapted for introduction through one of the cavities of a corner piece and further into a corresponding recessed groove in a side member of the frame for the purpose of interconnecting two or more adjacent display frames at nearby situated corners.

In another embodiment of the invention one or more dowels of a coupling member have one or more nibs, which project through the external opening of the recessed groove for the purpose of preventing the dowel member from rotating about its longitudinal axis relative to the groove.

In a third embodiment the dowel has a cross portion shaped so as to force said cross portion to project so far outside the dowel that the cross portion cannot be introduced into the cavity in the corner piece in order thus to limit the distance over which the dowel can be inserted through the corner piece and into the recessed groove of the frame piece.

In a fourth embodiment the cross portion is constituted by a ball applied to the dowel.

In a fifth embodiment the dowel is connect with a transversal sheet or disk functioning as a foot for the purpose of supporting the display frame in upright position at some distance from the base.

In a sixth embodiment the coupling member consists of two dowels arranged in axial alignment to each other for the purpose of interconnecting two display frames located, for example, one above the other.

In a seventh embodiment the coupling member is shaped as a U with two mutually parallel dowels for the purpose of interconnecting display frames located side by side.

In an eighth embodiment the coupling member has four dowel members interconnected in the form of an H for the purpose of interconnecting four display frames at adjacent corners of the frames in both lateral and vertical directions.

In a ninth embodiment the dowel member is dimensioned such that it can be introduced through the cavity of the corner piece and into the longitudinal recessed groove of the frame side but by overcoming a frictional resistance.

In a tenth embodiment the coupling member comprises two dowel arranged in alignment with one another and a tongue projecting roughly from the middle portion of the coupling member and perpendicularly from the dowels so as, when interconnecting two display frames, positioned for example above each other, the dowels are received by the recessed grooves of the frame pieces, whereas the tongue is received in the two cavities of the adjacent corner pieces.

In an eleventh embodiment the coupling member is composed of two, three or four coupling units, of which every one consists of two aligned dowels and one tongue vertically projecting therefrom, which tongues are interconnected at their edges remote from the dowels in such a manner that the tongues around their connection point are disposed with equally great angles between them, such as 180°, 120° or 90°, respectively, all dowels being situated in mutually parallel relationship.

In a twelfth embodiment the coupling member is composed of two, three or four T-shaped coupling units, each of which is formed of a stem portion in the shape of a dowel and a cross portion fixed to the end of each stem portion, which cross portions are interconnected at their one end in a common connection point in such a manner that the cross portions are disposed around their connection point with equally great angles between them, such as 180°, 120° or 90°, respectively, all dowels being situated in mutually parallel relationship.

The invention shall be described with reference to the attached drawings, of which FIG. 1 shows a display rack with two frames located side by side, FIGS. 2 and 3 show coupling members which are used in the display rack of FIG. 1, FIG. 4 shows a display rack with two lower larger frames and two upper minor frames, FIG. 5 shows a display rack built up from four equal frames, FIGS. 6 and 7 show coupling members used in the display racks of the FIGS. 4 and 5, FIG. 8 shows on a larger scale the lower coupling member in the rack of FIG. 5 and adjacent frame corners, FIG. 9 shows a section following line IX—IX in FIG. 8, FIG. 10 shows the use of a coupling member for attaching lighting sets, FIGS. 11 and 12 show different designs of foot plates or foot supports, FIG. 13 shows details of a corner of a frame presenting an other design of the extruded side piece, FIG. 14 shows a view in the direction of the arrow XIV in FIG. 13, FIG. 15 shows a side view of a straight, single, double-sided coupling member, FIG. 16 shows the coupling member of FIG. 15 in a top view, FIGS. 17 and 18 show in the same manner as FIGS. 15 and 16, a twofold, double-sided coupling member, FIGS. 19 and 20 show in the same manner a threefold, double-sided coupling member, FIGS. 21 and 22 show in a corresponding manner a fourfold, double-sided coupling member, FIG. 23 shows a side view of a twofold, single-sided coupling member, FIG. 24 shows the coupling member of FIG. 23 in a top view, FIGS. 25 and 26 show in the same manner as FIGS. 23 and 24 a threefold, single-sided coupling member, FIGS. 27 and 28 show in a corresponding manner a fourfold, single-sided coupling member, FIG. 29 shows in a perspective view the adjacent and interconnected corners of six display frames, FIG. 30 shows in a corresponding manner as FIG. 29 eight interconnected display frames, whereas FIGS. 31 and 32 show in perspective views three or, respectively, four interconnected display frames.

In the FIG. 1 the reference numerals 1 and 1′ denote two equal display frames, each of which is composed of two horizontal side pieces 4, two vertical side pieces 3, four corner pieces 5 and a pane 2. Through hollow-beam or tubular formations in the side pieces and cavities in the corner pieces elongated bar-shaped parts, coupling dowels, can be introduced. In FIG. 1, L-shaped legs 7 are introduced into the outer lower corners, while the adjacent located side pieces 3 are interconnected by U-shaped coupling members 6, as is shown nearer in FIG. 2.

In FIG. 2 the reference numerals 8, 8′ denote two legs in the form of coupling dowels for the coupling member 6. Reference numeral 9 denotes a hook, which connects the legs 8 and 8′ with one another, and reference numerals 10 denote balls threaded onto the legs and constituting stops against the corner pieces 5 under the insertion of the dowel shaped parts through a corner piece and into a side piece.

In FIG. 2 the left-hand leg is provided with two nibs 11, the function of which will be declared nearer more below.

FIG 3 shows the L-shaped leg 7 with a dowel member 13, which has two nibs 11.Reference numeral 10 denotes a ball as before, whereas reference numeral 14 denotes a foot on the L-shaped leg.

The display rack shown in FIG. 1 can be placed onto a support, against which the members 6 and 7 bear, and the rack can be set up steadily by the display frames 1, 1′ forming an angle with each other. It is also possible to turn the two display frames so that they become situated closely adjacent each other and then can easily be transported and mounted.

In FIG. 4 reference numerals 17, 17′ denote two pieces of upper display frames and 18, 18′ two pieces of lower display frames which in that area where their corners meet, are connected with an H-shaped coupling member 16. At the top in the centre the upper display frames are connected with a U-shaped coupling member 6. At the outer edges of the display rack the display frames are interconnected by means of straight coupling members 15, the dowel members of which are introduced through the corner pieces and into the side pieces.

FIG. 5 shows a display rack consisting of four equal display frames, two pieces of upper display frames 19, 19′ and two pieces of lower display frames 20, 20′. The display frames are connected with each other in the manner described above and the denotations are the same which have been used earlier.

FIG. 6 shows the H-shaped coupling member 16, which can be said to consist of two U-shaped coupling members 6, the hooks 9 are connected with each other. Reference numerals $16_1$, $16_2$, $16_3$ and $16_4$ denote the four mutually parallel dowels.

FIG. 7 shows the straight coupling member 15 with two outwards directed dowels 21, 21′, two balls 10, 10′ and a flattened portion 15′ in the center of the coupling member. In this embodiment the dowel members 21, 21′ do not have any nibs. Obviously, it is possible also to construct the above described U- and H-shaped coupling members with dowels without any nibs.

FIG. 8 shows on a larger scale the connection of the interior corners of the lower display frames 20, 20′ in FIG. 5 by means of a U-shaped coupling member. Previously used reference numerals denote the same details as earlier. 23 denotes recessed grooves in the side pieces 3, 3′, whereas with reference to FIG. 9.

FIG. 9 is a section following line IX—IX in FIG. 8. The figure shows a dowel-shaped coupling member 8 together with a nib 11 which projects between the two, oppositely directed grooves tongues 24, against which the nib 11 is slightly forced so as to prevent the dowel part 8 from rotating in the recessed groove 23. 25 denotes lateral walls in the groove 23, whereas 26 denotes the bottom wall of the groove. The dowel-shaped coupling member 8 is introduced into the recessed groove 23 in the longitudinal direction of the side piece through openings in the corner piece in a manner to be described later. It is obvious that if the dowel-shaped part 8 introduced into the recessed groove 23 does not have any nibs, but is totally circular, the dowel part 8 can be rotated in the groove 23. Positioned opposite to the groove 23 in the side piece is a further groove 30 with lateral walls 29 and a bottom 28. In the shown embodiment this groove is of uniform width and designed to receive a pane 2.

It is evident from the preceding description that the left-hand dowel member 8 in FIG. 8 due to the nibs 11 cannot rotate relatively to the side piece 3 in the groove 23 unless the U-shaped coupling member 6 is positioned in level with the left-hand display frame 20. Since the right-hand dowel member 8′ of the U-shaped member 6 does not have any nibs, the right-hand display frame 20′ can be swung about the dowel member 8′, so that the two display frames 20 and 20′ can be set into an angular position in relation to one another. It is obvious that is the left-hand dowel member 8 in FIG. 8 is also without nibs, both display frames can be turned about their dowel members. This permits to swinging the display frames flatly on top of each other to be piled together for more comfortable handling and transportation.

Shown in FIG. 10 is a superstructure added to the display rack of FIG. 4. Here, the upper U-shaped couping member 6 has been replaced by an H-shaped coupling member 16. Attached to the upwardly directred dowel members are arms 31 equipped with lamps. In this way an easy expedient is obtained for providing lighting of the panes comprised in the display rack.

FIG. 11 shows a development of the display rack shown in FIG. 5, where the lower members 6 and 12 of FIG. 5 have been exchanged for three pieces of display feet, each of which has a circular foot plate 35 and an upright 34. Each of the outer uprights has a simple dowel member 15, whereas the intermediate upright has been connected with a U-shaped coupling member 6. In this way the entire display rack can be placed at a desired height over the support.

FIG. 12 shows a similar construction where the circular foot plates 35 have been replaced by elongated flat irons 38. 36 denotes feet having a single dowel member 15, whereas 37 denotes a foot support with two spigot members interconnected in the shape of a U.

FIG. 13 is a perspective view of a corner piece 5 with two pairs of legs 39, 39' and 40, 40' extending perpendicularly to each other and a connection portion 41, 42 between the leg pairs 39–40 and 39'–40'. 43 denotes a nipple fixing the connection parts 41 and 42 with one another. 44 denotes a dowel member on any of the earlier described coupling members which passes through a cavity 45 in the corner piece 5 and is received within the recessed groove 23 in the side piece 4.

FIG. 14 is a view in the direction of the arrow XIV in FIG. 13. Evident from the figure are the two connection parts 41, 42, the connection nipple 43 as well as the cavity 45 in the corner piece through which the dowel member 44 can pass in order to be inserted into the recessed groove 23 in the side piece 4.

From the FIG. 13 there becomes evident, the shape of the side piece 4 corresponding to that shown in FIG. 9. In the figure, reference numeral 23 denotes the recessed groove for taking up the dowel member 44 of a coupling member, whereas 46 denotes a groove for a pane 2. The groove 46 presents at its opening two groove tongues 47, the spacing between them being adjusted to the thickness of the pane 2 belonging to the display frame. The groove 46 has also been made deeper than has been described before in order to ensure a safer grasp of the edge of the pane which is valuable especially when the frame pieces become excessively long and easily liable to be bent out.

FIG. 15 shows a single, double-sided coupling member 61 with two dowel members 60 and 60', which are located in line with each other. Projecting perpendicularly from the centre of the coupling member is a tongue 59 which has an edge 59' directed away from the dowels. FIG. 16 shows the member viewed from above in FIG. 15. The numerals are the same in the FIGS. 15 and 16. The coupling member shown in the FIGS. 15 and 16 may be used instead of the right-hand coupling member 15 shown in FIG. 4, the dowels 60 and 60' then being inserted into the recessed groove in the upper dispaly frame 17 or 17' or the lower display frame 18, 18', whereas the tongue 59 is received by the adjacent cavities 45 between the legs of the corner pieces 5 directed, according to FIG. 4, towards the centre of the display rack.

FIGS. 17 and 18 show a twofold, double-sided coupling member 62 with two tongues $62_1$ and $62_2$. The coupling member 62 can be imagined as composed of two coupling members 61 joined together at 62'. All dowels in the coupling member 62 are parallel with one another.

FIGS. 19 and 20 show in a corresponding manner a three-fold, double-sided coupling member 63 composed of three single members according to the FIGS. 15 and 16, the tongues $63_1$, $63_2$ and $63_3$ of which are interconnected at the same place 63' in such a manner that a coupling member with six dowels distributed in pairs at the same distance from each other is obtained. The tongues $63_1$–$63_3$ are taken up by the cavities 45 of the corner pieces 5 in the same manner as described in connection with the FIGS. 15 and 16.

FIGS. 21 and 22 show a fourfold, double-sided coupling member 64 composed of four coupling members according to the FIGS. 15 and 16 and having four tongues $64_1$, $64_2$, $64_3$ and $64_4$ which are joined together at the same point 64', as is evident from the FIG. 22.

FIG. 29 shows a joining between the corners of three upper and three display frames by means of the coupling member 63 shown in the FIGS. 19 and 20.

FIG. 30 shows four upper and four lower display frames which are coupled together by means of the coupling member 64 shown in the FIGS. 21 and 22.

FIG. 23 shows a twofold, single-sided coupling member 72 composed of two T-shaped coupling units with stem portions $72_1$ and $72_2$ and cross portions $71_1$, $71_2$, said portions $72_1$ and $72_2$ constituting dowels for cooperation with a frame corner in a manner described earlier.

FIG. 24 shows the coupling member of FIG. 23 in a top view, with the same reference numerals used.

Figure 1:
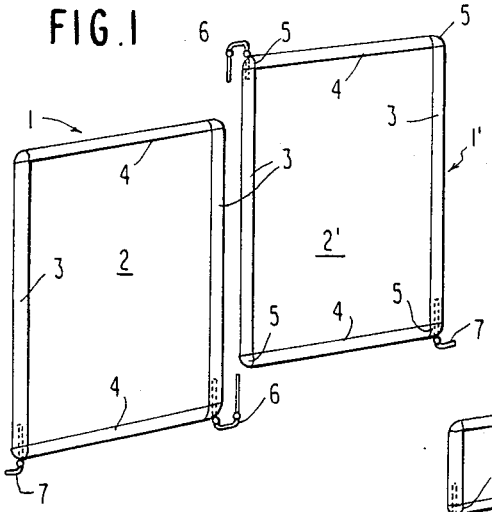
Figure 2:
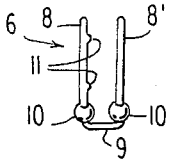
Figure 3:
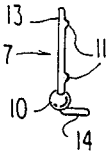
Figure 4:
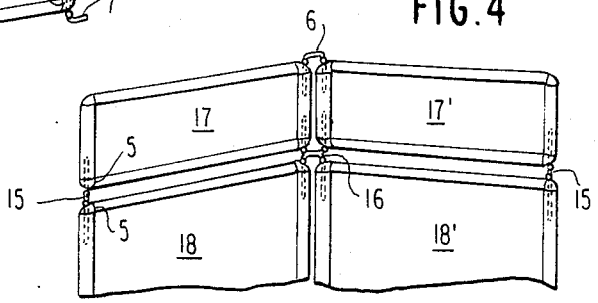
Figure 5:
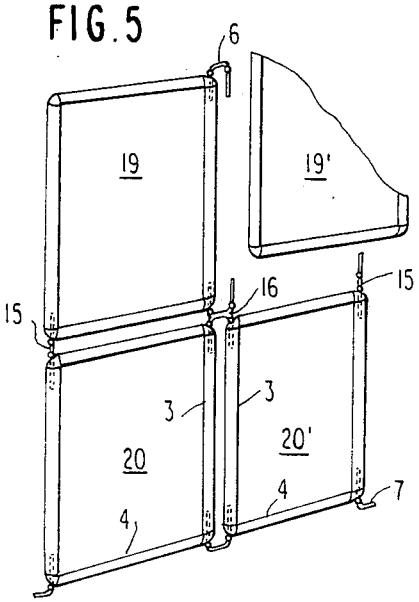
Figure 6:
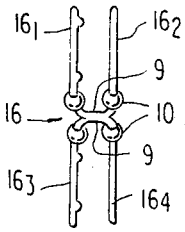
Figure 7:
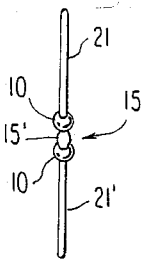
Figure 8:
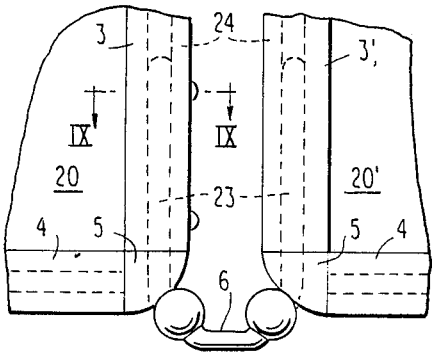
Figure 9:
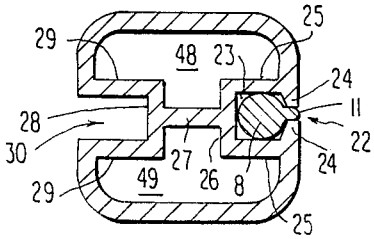

FIG. 25 shows a threefold, signle-sided coupling member 73, which consists of three T-shaped members with stems $73_1$, $73_2$ and $73_3$ directed upwards in the figure and having an appertaining cross portion $75_1$, $75_2$ and $75_3$, respectively, which portions at their one end are interconnected at the point 73' in such a manner that the cross portions $75_1$–$75_3$ are situated in the same plane, whereas the shafts $73_1$–$73_3$, which constitute coupling dowels, are directed vertically upwards from said plane and are parallel with one another.

FIG. 26 shows the coupling member 73 of FIG. 25 in a top perspective view.

FIGS. 27 and 28 show in a corresponding manner a fourfold, single-sided coupling member 74 consisting of four T-shaped members with stems $74_1$–$74_4$ and cross pieces denoted, respectively $76_1$–$76_4$, which latter are interconnected at a point 74', see FIG. 28. The cross pieces $76_1$–$76_4$ lie in the same plane and the shafts $74_1$–$74_4$ are parallel and form a right angle with said plane.

FIG. 31 shows three display frames which are interconnected by means of the coupling member shown in the FIGS. 25 and 26, which is suited for e.g. display frames placed on a support such as a floor. FIG. 32 finally shows four display frames, which are placed on a support and interconnected by such a member as shown in the FIGS. 27 and 28.

The invention can be modified by an expert in the art in various manners deviating from what has been described hereinbefore, but within the scope of the subsequent patent claims.

What is claimed is:

1. Display rack comprising a plurality of display frames enclosing flat panes and interconnected by coupling members, each display frame comprising frame side members and corner pieces interconnecting adjacent ends of said side members, said frame members being extruded profiles having a constant cross-section over the entire length thereof including two parallel tube portions interconnected by a bridge portion and having between said tube portions two longitudinal grooves, said grooves having openings in opposite directions and the bridge portion being located mainly in the plane of the completed display rack, said corner pieces having at least two pairs of mutually perpendicular legs, the legs of each pair being mutually parallel and inserted into said tube portions of the frame side members under friction, the improvement wherein at least one externally located longitudinal groove of each display frame has a longitudinal axis, is recessed having said outwardly facing opening along the entire length of the groove and being narrower than the rest of the groove, a dowel member of each of said coupling member positioned within the groove and including a portion preventing said dowel member from being forced out of the groove transversely to the longitudinal axis thereof, said corner pieces being formed with cavities constituting extensions of the recessed grooves of the frame side members with the dowel members passing without any obstacle through the corner pieces and into said recessed grooves, and wherein each coupling member comprises at least two said dowel members, each of which is introduced through one of the cavities of a corner piece and projected further into the corresponding recessed groove in a frame side member to interconnect at least two adjacent display frames at a given corner of said display rack.

2. Display rack according to claim 1, wherein at least one dowel member of a coupling member has at least one nib projecting through the opening of the recessed groove for the purpose of preventing the dowel member from rotating about its longitudinal axis relative to the groove.

3. Display rack according to claim 1. wherein at least one dowel member has a cross portion such that said cross portion projects outside the dowel member such that the cross portion cannot enter into the cavity a corner piece to limit the distance that the dowel member can be inserted through the corner piece and into the recessed groove of the frame side member.

4. Display rack according to claim 3, wherein the cross portion si constituted by a ball applied to the dowel member.

5. Display rack according to claim 1, wherein the dowel member is connected with a transversal foot for supporting the display frame in upright position at some distance from a base thereof.

6. Display rack according to claim 1, wherein the coupling member consists of two dowel members arranged in axial alignment to each other and interconnecting two display frames located one above the other.

7. Display rack according to claim 1, wherein the coupling member is U-shaped with two mutually parallel dowel members interconnecting two display frames located side by side.

8. Display rack according to claim 1, wherein the coupling member has four dowel members interconnected in the form of an H interconnecting four display frames at adjacent corners of the frames in both lateral and vertical directions.

9. Display rack according to claim 1, wherein the dowel member is dimensioned such that is passes through the cavity of the corner piece and into the longitudinal recessed groove of the frame side under a frictional restraint.

10. Display rack according to claim 1, wherein the coupling member comprises two dowel members arranged in axial alignment with one another and a tongue projects roughly from the middle portion of the coupling member and perpendicularly from the dowel members so as to interconnect two display frames, positioned above each other, with the dowel members received by the recessed grooves of the frame side members and with the tongue received in two cavities respectively of adjacent corner pieces.

11. Display rack according to claim 1, wherein the coupling member is composed of at least two coupling units, each of which consists of two aligned dowel members and one tongue perpendicularly projecting therefrom, which tongue is interconnected at their eges remote from the dowel members in such a manner that the tongues around their connection point are disposed with equal angles between them, and all dowel members are situated in mutually parallel relationship.

12. Display rack according to claim 1, wherein the coupling member T-shaped coupling units, each of which is formed of a stem portion in the shape of a dowel member and a cross portion is fixed to the end of each stem portion, with said cross portions interconnected at their one end in a common connection point in such a manner that the cross portions are disposed around their connection point with equal angles between them, and wherein all dowel members are situated in mutually parallel relationship.

* * * * *